United States Patent [19]

Rodgers et al.

[11] Patent Number: 4,664,528

[45] Date of Patent: May 12, 1987

[54] APPARATUS FOR MIXING WATER AND EMULSION POLYMER

[75] Inventors: James C. Rodgers, Pipersville; John R. Schieber, Holland, both of Pa.

[73] Assignee: Betz Laboratories, Inc., Trevose, Pa.

[21] Appl. No.: 789,048

[22] Filed: Oct. 18, 1985

[51] Int. Cl.[4] ..... B01F 15/04

[52] U.S. Cl. ..... 366/142; 366/137; 366/143; 366/336; 137/566

[58] Field of Search ..... 366/150, 132, 142, 143, 366/152, 162, 336, 337, 338, 339, 340, 136, 137, 131; 137/565, 566; 422/243, 292, 901

[56] References Cited

U.S. PATENT DOCUMENTS

| | | | |
|---|---|---|---|
| 1,789,897 | 1/1931 | Gregg . | |
| 2,389,012 | 11/1945 | Trist | 252/359 |
| 2,894,732 | 7/1959 | Taber | 366/336 |
| 3,385,474 | 5/1968 | Roby, Jr. | 222/57 |
| 3,661,364 | 5/1972 | Lage | 259/95 |
| 4,113,440 | 9/1978 | Klaasen | 137/566 |
| 4,117,550 | 9/1978 | Folland | 366/336 |
| 4,299,501 | 11/1981 | Patil et al. | 366/349 |
| 4,352,572 | 10/1982 | Chen | 366/336 |
| 4,518,261 | 5/1985 | Sekimoto | 366/150 |

OTHER PUBLICATIONS

Advertisement for Norchem Industries' ANCAT Liquid Polymer Feeder.

Advertisement for Stranco's Polyblend Series 1000.

Advertisement for Stranco's Polyblend "The Solution to Polymer Feed Problems".

*Primary Examiner*—Robert W. Jenkins

*Attorney, Agent, or Firm*—Alexander D. Ricci; Bruce E. Peacock; James D. Dee

[57] ABSTRACT

An apparatus and method for mixing water and a water-soluble emulsion polymer by providing the optimum amount of mixing energy required for the polymer to effectively dissolve the polymer in the water without causing the polymer molecules to shear into smaller polymer molecules. The apparatus includes a pump means, a static mixing means and a mixing chamber means. A first circulation means connects the pump means to the mixing chamber means. A second circulation means connects the pump means to the static mixing means and further connects the static mixing means the mixing chamber means. A third circulation means connects the static mixing means to the mixing chamber means. Additionally, a flow control means selectively circulates a combined stream of the water and the polymer alternatively through the first circulation means, the second circulation means or the third circulation means. The method of using this apparatus is also disclosed.

19 Claims, 7 Drawing Figures

APPARATUS FOR MIXING WATER AND EMULSION POLYMER

BACKGROUND OF THE INVENTION

The present invention relates generally to the field of mixing water and emulsion polymers and more particularly to mixing water and water-soluble emulsion polymers having water-polymer gel particles suspended in oil with the aid of surface active dispersants to produce a homogeneous mixture.

Water-soluble polymers may be anionic, cationic or non-ionic. These polymers are used either alone or in combination with other aids in the coagulation and flocculation of water-insoluble particles suspended in an aqueous medium. More specifically, these polymers are used as flocculants or coagulation aids in the clarification of water, dewatering of sludges and in certain process applications. When dissolved in water, these polymers uncoil into very long extended molecules which function to bridge the suspended particles together to improve liquid-solids separation in the water.

The water-soluble polymers may be produced in a dry powder form and then mixed with water when the polymers are needed for use. As an alternative to producing the dry powder form, some of these polymers are supplied in an emulsion form. In the emulsion form, water-polymer gel particles or dry polymer particles are suspended in oil with the aid of surface active dispersants or surfactants. The surface active dispersants or surfactants are used to create and maintain a stable emulsion. Other dispersants or surfactants are added to the emulsion to disperse the oil phase in the water phase when the emulsion polymer is diluted with water.

In order to effectively utilize the water-soluble emulsion polymers, these polymers are diluted with water to produce a solution having maximum viscosity for any given concentration. Generally, a solution having a concentration of the emulsion polymer greater than about 1% will resemble a gel and, as can be appreciated, will be made virtually unusable for the purpose. It is believed that during the procedure of diluting the emulsion polymers with water, sufficient mixing must occur or enough mixing energy must be supplied to displace the dispersants or surfactants from the surface of the water-polymer gel particles to allow the water to penetrate the gel/oil interface so that the polymer will contact and dissolve in the water phase. The other dispersants or surfactants present in the emulsion then disperse or emulsify the oil in the water phase. Thus, a viscous homogeneous mixture or solution is produced with activated polymer which is ready to use for the purpose. However, if too much mixing or agitation occurs during the dilution procedure, the dissolving polymer molecules will be sheared into smaller molecules, thereby resulting in a damaged polymer product which is ineffective to use. If too little mixing or agitation occurs during the initial dilution procedure, the dispersants or surfactants that are present to emulsify the oil carrier will disperse that oil even though the oil still contains some water-polymer gel particles. These particles are, in effect, encapsulated in the oil that is then dispersed in the water. The encapsulated gel particle cannot thereafter dissolve. If sufficient mixing is later performed to break the encapsulation, the polymer molecules that have already dissolved in the water will be sheared or broken. As a result, the final viscosity of the solution will never reach the maximum potential and performance of the polymer will correspondingly drop.

Various apparatus are commercially available for mixing water-soluble emulsion polymers and water together to produce a homogeneous mixture. Such apparatus make use of mixing chamber devices, pumping devices, or static mixing devices to mix the emulsion polymers and water. However, the present inventors have found that different emulsion polymers require different amounts of effective mixing energy. While the prior art apparatus may be suitable for mixing certain emulsion polymers, such apparatus are generally unsuitable for effectively mixing other emulsion polymers since such apparatus may provide either too much mixing energy or too little mixing energy for these other polymers. The amount of water and the amount of emulsion polymer that goes through such devices may be varied, but such apparatus suffer from the disadvantage that such devices provide a fixed amount of mixing or mixing energy. The amount of mixing energy supplied by such apparatus upon initial dilution of the polymer with water generally cannot be adjusted to obtain the optimum mixing energy for different polymers so that maximum activation of the mixture is achieved for each polymer. That is, such apparatus cannot be adjusted to supply optimum mixing for various emulsion polymers to sufficiently mix each polymer and water to displace the surface active dispersants from the water-polymer gel surface to allow the water to contact the polymer and to dissolve the polymer in the water, upon initial dilution of the polymer with water, without causing the polymer molecules to shear into smaller polymer molecules.

OBJECTS OF THE INVENTION

Accordingly, it is a general object of the present invention to provide an apparatus and method which overcome the disadvantages of the prior art.

It is a further object of the present invention to provide an apparatus and method for mixing water and emulsion polymer to effectively dissolve the emulsion polymer in the water without causing the polymer molecules to shear into smaller molecules.

It is a further object of the present invention to provide an apparatus and method for mixing water and water-soluble emulsion polymers having water-polymer gel particles suspended in oil with the aid of surface active dispersants to sufficiently displace the surface active dispersants from the water-polymer gel surface to allow the water to contact the polymer and to dissolve the polymer in the water upon initial dilution of the polymer with water, without causing the polymer molecules to shear into smaller molecules.

SUMMARY OF THE INVENTION

These and other objects of the instant invention are achieved by providing an apparatus and method for mixing water and emulsion polymers to effectively dissolve the emulsion polymer in the water without causing the emulsion polymer molecules to shear into smaller polymer molecules. The apparatus comprises a pump means, having an inlet adapted to receive and combine the water and the emulsion polymer to form a combined stream of water and emulsion polymer, which is operable to mix the combined stream. The apparatus further comprises a static mixing means for mixing water and polymer, having an inlet adapted to receive and combine the water and the emulsion polymer to form the combined stream, which is capable of mixing the combined stream. The apparatus also comprises a mixing chamber means for producing a homogeneous mixture of the water and emulsion polymer. A first circulation means connects the pump means to the mixing chamber means for circulating the combined stream through the pump means to the mixing chamber means. A second circulation means connects the pump means to the static mixing means and further connects the static mixing means to the mixing chamber means for circulating the combined stream through the pump means to the static mixing means and then to the mixing chamber means. A third circulation means connects the static mixing means to the mixing chamber means for circulating the combined stream through the static mixing means to the mixing chamber means. A flow control means is connected to the first circulation means, the second circulation means and the third circulation means. The flow control means controls the flow of the combined stream to selectively circulate the combined stream alternatively through the first circulation means, the second circulation means, or the third circulation means, to provide sufficient mixing to effectively dissolve the emulsion polymer in the water without causing the polymer molecules to shear into smaller molecules.

The method comprises combining a water stream with an emulsion polymer stream to form a combined stream. The method further comprises subsequently controlling the flow of the combined stream to selectively circulate the flow through the pump means, the static mixing means and the mixing chamber means to effectively dissolve the emulsion polymer in the water without causing the emulsion polymer molecules to shear into smaller polymer molecules.

The present apparatus and method provide the specific, optimum amount of mixing energy required for each emulsion polymer. The apparatus is capable of being adjusted to provide the intensity and duration of mixing required to effectively dissolve the emulsion polymer in water.

BRIEF DISCUSSION OF THE DRAWINGS

DETAILED DESCRIPTION OF THE INVENTION

Figure 1:
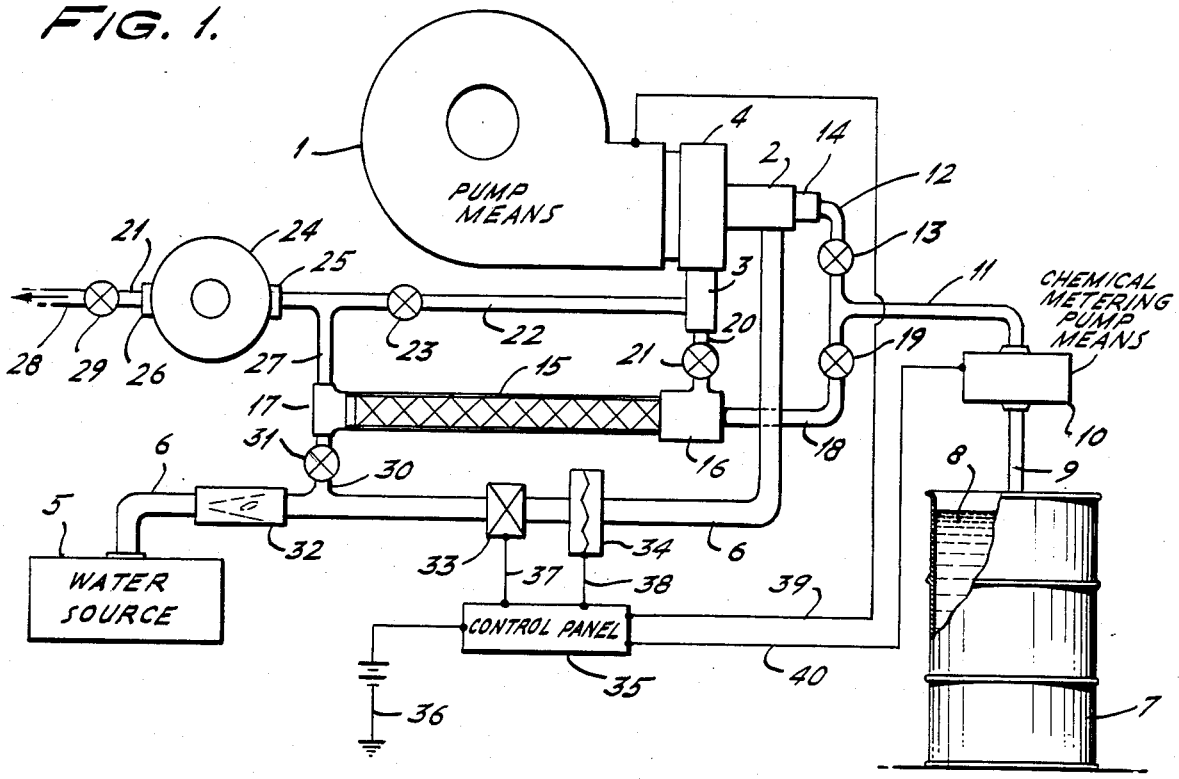
FIG. 1 is a schematic representation showing one embodiment of the apparatus in accordance with the present invention.

The present invention provides for an apparatus and method for sufficiently mixing water and water-soluble emulsion polymer to effectively dissolve the emulsion polymer in the water without causing the emulsion polymer molecules to shear into smaller polymer molecules. Examples of such water-soluble emulsion polymers include cationic, anionic, and non-ionic emulsion polymers. Generally, the emulsion polymers are in neat form and have water-polymer gel particles or dry polymer particles suspended in oil with the aid of surface active dispersants.

A clear understanding of the present invention can be had by reference to the accompanying drawings. Although specific forms of the invention have been selected for illustration in the drawings themselves, the descriptions thereof are not intended to limit the scope of the present invention.

FIG. 1 illustrates one embodiment of an apparatus for mixing water and water-soluble emulsion polymer constructed in accordance with the present invention. The apparatus is arranged to effect a uniform and homogenous mixing of water and water-soluble emulsion polymer. The apparatus is capable of supplying a range of mixing conditions. The apparatus can be adjusted to provide a specific, optimum amount of mixing energy to effectively dissolve the emulsion polymer in the water thereby more fully activating the polymer. The apparatus can generally be used to feed a solution of water and activated polymer to a system in any application where the use of the polymer is desired. Such use of the polymer includes the utilization of the polymer as a flocculant or coagulant. Examples of such applications are in the clarification of water and the dewatering of sludges.

As can be seen in FIG. 1, the apparatus basically comprises a pump means 1 for pumping water through the apparatus. By pumping the water, the pump means 1 produces a water stream which flows through the apparatus. The pump means 1 is operable to mix a combined stream of water and emulsion polymer when the emulsion polymer is supplied to the pump means 1. The pump means 1 includes an inlet 2 adapted to receive the water and the emulsion polymer and to combine the water and the polymer to form the combined stream when the emulsion polymer is supplied to the pump means 1. The pump means 1 can also include an outlet 3 through which the water stream exits from the pump means 1 and through which the combined stream exits when the emulsion polymer is supplied to the pump means 1. The pump means 1 can be a centrifugal pump or a turbine pump, both of which are well known in the art. Additionally, the pump means 1 can have a rotor face 4 positioned adjacent to the inlet 2 of the pump means 1 and may have variable speed or horsepower. By changing the speed or horsepower of the pump means 1, the mixing energy can be varied.

Water is supplied to the pump means 1 from a source of water 5 by a water supply conduit 6 which connects the source of water 5 to the inlet 2 of the pump means 1. Preferably, the water supply conduit 6 is connected to the source of water so as to be capable of delivering sufficient water for optimum dilution.

A source of the emulsion polymer includes a vessel 7 containing a neat emulsion polymer 8. Examples of such a vessel 7 include a drum, semi-bulk tank, bulk tank or other suitable delivery or storage vessel. A polymer inlet 9 connects the vessel 7 to a chemical metering pump means 10 for pumping the emulsion polymer through the apparatus. By pumping the emulsion polymer, the chemical metering pump means 10 produces an emulsion polymer stream which flows through the apparatus. The chemical metering pump means 10 can be any reliable, accurate chemical metering pump that has appropriate delivery capacity to pump the neat emulsion polymer, such as a diaphragm pump. A polymer delivery conduit 11 is connected to the chemical metering pump means 10. A first polymer supply conduit 12 connects the polymer delivery conduit 11 to the inlet 2 of the pump means 1. The first polymer supply conduit 12 in conjunction with the polymer delivery conduit 11 provide a fluid flow path for the emulsion polymer stream from the chemical metering pump means 10 to the pump means 1 for supplying the emulsion polymer to the pump means 1.

The apparatus of the present invention can include an injection lance means 14 for injecting the emulsion polymer through the inlet 2 of the pump means 1 close to the rotor face 4 so as to cause the emulsion polymer to be broken into small droplets. The injection lance means 14 is coupled to the inlet 2 of the pump means 1 and connected to the first polymer supply conduit 12. The emulsion polymer can be more effectively mixed with the water in the pump means 1 when the polymer is broken into small droplets. The polymer injection means 14 also reduces the likelihood of water intrusion into the first polymer supply conduit 12.

The apparatus further basically comprises a static mixing means 15 for mixing the water and the emulsion polymer when water and emulsion polymer are supplied to the static mixing means 15. The static mixing means 15 has an inlet 16 adapted to receive the water and the emulsion polymer to form the combined stream when water and emulsion polymer are supplied to the static mixing means 15. The static mixing means 15 also has an outlet 17 through which the combined stream exits from the static mixing means 15 after the combined stream has been mixed while passing through the static mixing means 15. The static mixing means 15 is capable of mixing the combined stream of water and emulsion polymer and is of the type well known in the art. For example, the static mixing means 15 can be comprised of a straight conduit containing a system of baffles designed to thoroughly mix a solution, such as a solution of water and polymer produced by the present invention.

A second polymer supply conduit 18 connects the polymer delivery conduit 11 to the inlet 16 of the static mixing means 15. The second polymer supply conduit 18 in conjunction with the polymer delivery conduit 11 provide a fluid flow path for the emulsion polymer stream from the chemical metering pump means 10 to the static mixing means 15 for supplying the emulsion polymer to the static mixing means 15.

A polymer flow control means connected to the first polymer supply conduit 12 and the second polymer supply conduit 18 regulate the passage of the emulsion polymer either to the pump means 1 or, alternatively, to the static mixing means 15. As illustrated in the embodiment of the present invention shown in FIG. 1, the polymer flow control means can include a valve 13 in the first polymer supply conduit 12 for controlling fluid flow of emulsion polymer from the polymer delivery conduit 11 to the inlet 2 of the pump means 1. The valve 13 in the first polymer supply conduit 12 is operable when open to permit fluid flow of the emulsion polymer stream from the chemical metering pump means 10 to the pump means 1 and is operable when closed to prevent such fluid flow. As shown in FIG. 1, the polymer flow control means further includes a valve 19 in the second polymer supply conduit 18 for controlling fluid flow of emulsion polymer from the polymer delivery conduit 11 to the inlet 16 of the static mixing means 15. The valve 19 in the second polymer supply conduit 18 is operable when open to permit fluid flow of the emulsion polymer stream from the chemical metering pump means 10 to the static mixing means 15 and is operable when closed to prevent such fluid flow.

The apparatus also basically comprises a mixing chamber means 24 for producing a homogenous mixture of the water and the emulsion polymer. The mixing chamber means 24 mixes and ages the water and emulsion polymer. If the chemical metering pump means 10 pumps in pulsations, the mixing chamber means 24 equalizes the fluid flow of the mixture of water and emulsion polymer to provide a more consistent polymer/water ratio. The mixing chamber means 24 can be equalization chamber of known construction having transparent chamber walls to serve as a visual indication that the chemical metering pump means 10 is pumping the emulsion polymer through the apparatus. The mixing chamber means 24 can have an inlet 25 and a plurality of distribution orifices connected to an outlet 26 of the mixing chamber means 24 to effect a mixing action of the water and emulsion polymer.

A first circulation means connects the pump means 1 to the mixing chamber means 24 for circulating the combined steam from the pump means 1 to the mixing chamber means 24. The first circulation means comprises a first flow conduit 22 connecting the outlet 3 of the pump means 1 to the inlet 25 of the mixing chamber means 24. The first flow conduit 22 provides a fluid flow path for the combined stream from the pump means 1 to the mixing chamber means 24.

A second circulation means connects the pump means 1 to the static mixing means 15 and further connects the static mixing means 15 to the mixing chamber means 24 for circulating the combined stream from the pump means 1 to the static mixing means 15 and then to the mixing chamber means 24. As illustrated in the embodiment of the present invention shown in FIG. 1, the second circulation means can include a second flow conduit 20, a third flow conduit 27 and a portion of the first flow conduit 22. The second flow conduit 20 connects the outlet 3 of the pump means 1 to the inlet 16 of the static mixing means 15. The second flow conduit 20 provides a fluid flow path for the water stream and the combined stream from the pump means 1 to the static mixing means 15. The third flow conduit 27 connects the outlet 17 of the static mixing means 15 to the first flow conduit 22. The third flow conduit 27 provides a fluid flow path for the combined stream from the outlet 17 of the static mixing means 15 to the first flow conduit 22.

A third circulation means connects the static mixing means 15 to the mixing chamber means 24 for circulating the combined stream from the static mixing means 15 to the mixing chamber means 24. As illustrated in the embodiment of the present invention shown in FIG. 1, the third circulation means can include the third flow conduit 27 and a portion of the first flow conduit 22. Alternatively, the third circulation means can be comprised of a fourth flow conduit (not shown) directly connecting the outlet 17 of the static mixing means 15 to the mixing chamber means 24.

A flow control means is connected to the first circulation means, the second circulation means and the third circulation means for controlling the flow of the combined stream to selectively circulate the combined stream alternatively through the first circulation means, the second circulation means or the third circulation means. The flow control means can be connected to the first flow conduit 22 and the second flow conduit 20 for regulating the passage of the water and emulsion polymer from the outlet 3 of the pump means 1 to the inlet 16 of the static mixing means 15 and to the mixing chamber means 24. As illustrated in the embodiment of the present invention shown in FIG. 1, the flow control means comprises a valve 23 in the first flow conduit 22 located between the third flow conduit 27 and the outlet 3 of the pump means 1 and a valve 21 in the second flow conduit 20. The valve 23 in the first flow conduit 22 controls fluid flow of water and emulsion polymer between the outlet 3 of the pump means 1 and the mixing chamber means 24. The valve 23 in the first flow conduit 22 is operable when open to permit fluid flow from the pump means 1 to the mixing chamber means 24 and is operable when closed to prevent such fluid flow. The valve 21 in the second flow conduit 20 controls fluid flow between the outlet 3 of the pump means 1 and the inlet 16 of the static mixing means 15. The valve 21 in the second flow conduit 20 is operable when open to permit fluid flow from the pump means 1 to the static mixing means 15 and is operable when closed to prevent such fluid flow.

A recirculation means connects the pump means 1 and the static mixing means 15 to the inlet 2 of the pump means 1 for recirculating at least a portion of the combined stream through the pump means 1 prior to circulating the combined stream to the mixing chamber means 24. As illustrated in the embodiment of the instant invention shown in FIG. 1, the recirculation means comprises a recirculation conduit 30 connecting the third flow conduit 27 and the outlet 17 of the static mixing means 15 to the water supply conduit 6 for recirculating at least a portion of the mixed water and emulsion polymer to the inlet 3 of the pump means 1 prior to passage of the mixed water and emulsion polymer to the mixing chamber means 24. The recirculation conduit 30 includes a valve 31 connected therein for controlling fluid flow recirculation of the combined stream through the recirculation conduit 30. The valve 31 in the recirculation conduit 30 is operable to control or modulate fluid flow of the mixed portion from the outlet 3 of the pump means 1 and the outlet 17 of the static mixing means 15 to the inlet 2 of the pump means 1 prior to passage of the mixed water and emulsion polymer to the mixing chamber means 24.

A discharge conduit 28 connects the outlet 26 of the mixing chamber means 24 to a point of use for the intended application of the mixture. A valve 29 in the discharge conduit 28 throttles the fluid flow rate of the mixture in the apparatus and controls the discharge of the mixture of water and emulsion polymer to the point of use and provides back-pressure for regulating the mixing energy and amount of recirculation.

A flow measuring means 32 can be connected to the water supply conduit 6 for monitoring the water flow rate through the water supply conduit 6. The flow measuring means 32 can be a rotometer of known construction or other flow measuring device suitable for the purpose. Also, a flow switch 33 of known construction can be connected to the water supply conduit 6. The flow switch 33 is operable to detect an inadequate water flow rate in the water supply conduit 6. Furthermore, a pressure switch 34 of known construction can be connected to the water supply conduit 6. The pressure switch 34 is operable to detect inadequate water pressure in the water supply conduit 6.

The apparatus of the present invention can be generally supported on some type of frame (not shown). A control panel 35 for regulating the various functions of the apparatus can be included on the frame or located separate from the rest of the apparatus. The control panel 35 has an automatic electrical switch and an automatic timer. The control panel 35 is electrically connected to a power source (not shown) by a first electrical circuit 36. The control panel 35 is further electrically connected to the flow switch 33 by a second electrical circuit 37 and to the pressure switch 34 by a third electrical circuit 38. The control panel also is electrically connected to the pump means 1 by a fourth electrical circuit 39 and to the chemical metering pump 10 by a fifth electrical circuit 40.

The control panel 35 supplies power, delivered from the power source through the first electrical circuit 36, to the pump means 1 through the fourth electrical circuit 39 for energizing the pump means 1. The control panel 35 also supplies power through the fifth electrical circuit 40 to the chemical metering pump means 10 for energizing the chemical metering pump means 10. The flow switch 33 sends an electrical signal through the second electrical circuit 37 to the control panel 35 when inadequate water flow is detected by the flow switch 33 in the water supply conduit 6. The pressure switch 34 sends an electric signal through the third electrical circuit 38 to the control panel 35 when inadequate water pressure is detected by the pressure switch 34 in the water supply conduit 6. In the event inadequate water flow is detected by the flow switch 33 or inadequate water pressure is detected by the pressure switch 34, the automatic switch of the control panel 35 will terminate the supply of power to the chemical metering pump means 10. Therefore, if the apparatus is starved for water, the chemical metering pump means 10 will stop immediately. The automatic timer of the control panel 35 is preset for a predetermined time delay, which can generally be from 1 to about 1000 seconds. Preferably, the time delay is about 16 seconds. When inadequate water flow is detected or inadequate water pressure is detected, the automatic timer of the control panel 35 will terminate the supply of power to the pump means 1 if adequate water flow and adequate water pressure have not been restored during the preset time interval. Thus, accidental feed of inadequately diluted emulsion polymer to the point of use will be prevented. Furthermore, during normal shutdown of the apparatus, the pump means 1 will continue to flush itself with water until the preset time limit is reached. However, if adequate water flow and adequate water pressure are restored before the preset time limit is reached, the power supply to the pump means 1 will not be terminated by the automatic switch of the control panel 35 and the pump means 1 will continue to operate.

A method of the present invention basically comprises combining the water stream with the emulsion polymer stream to form the combined stream of the water and the emulsion polymer. The flow of the combined stream is subsequently controlled to selectively circulate the flow through alternate circulation means including the first circulation means, the second circulation means and the third circulation means, thereby sufficiently mixing the water and the emulsion polymer to displace the surface active dispersants from the water-polymer gel surface to allow the water to contact the polymer and to effectively dissolve the polymer in the water, upon initial dilution of the polymer with water, without causing the polymer molecules to shear into smaller polymer molecules.

More particularly, the method or process of the instant invention comprises establishing the pump means 1 and the static mixing means 15 in a parallel relationship. The water stream is passed through the pump means 1. Furthermore, the emulsion polymer stream is passed to the polymer flow control means. The polymer flow control means is regulated to pass the emulsion polymer stream either to the pump means 1 or, alternatively, to the static mixing means 15. The water stream is then combined with the emulsion polymer stream to form the combined stream. The combined stream is subsequently either passed through the pump means 1 to mix the water and emulsion polymer when the polymer flow control means is regulated to pass the emulsion polymer stream to the pump means 1 or, alternatively passed through the static mixing means 15 to mix the water and emulsion polymer when the polymer flow control means is regulated to pass the emulsion polymer stream to the static mixing means 15. The combined stream is then passed to the flow control means and the flow control means is regulated to pass the combined stream either directly to the mixing chamber means 24 to produce a homogenous mixture of the combined stream or, alternatively, through the pump means 1 in combination with the static mixing means 15 to the mixing chamber means 24 when additional mixing is necessary. Furthermore, at least a portion of the combined stream can be recirculated and combined with the water stream when the water stream is passed through the pump means 1, prior to passing the combined stream to the mixing chamber means 24.

The operation of the embodiment of the instant apparatus heretofore described with respect to FIG. 1 and the method of the present invention can be more fully understood by reference to FIGS. 2–6, which illustrate alternate circulation patterns or mixing options for the flow of the water and the emulsion polymer provided by the apparatus or pursuant to the method.

Figure 2:
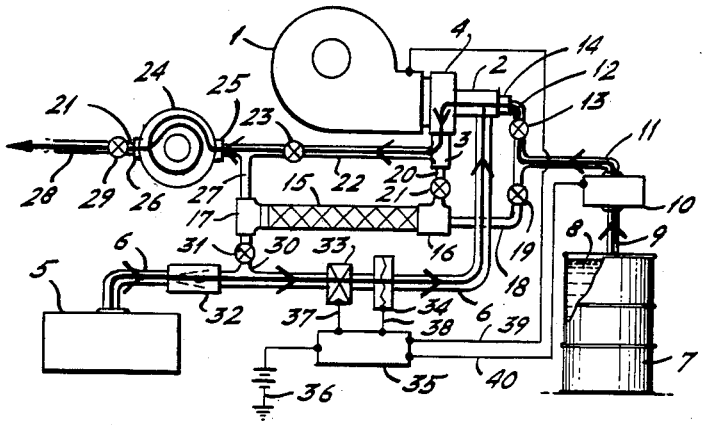
FIG. 2 is a schematic of the embodiment of FIG. 1 showing a first circulation pattern for the flow of the water and polymer through the apparatus.

FIG. 2 illustrates a first circulation pattern or first mixing option which includes circulating the flow through the pump means 1 to the mixing chamber means 24. To provide the first circulation pattern, the polymer flow control means is regulated to provide for passage of the emulsion polymer only to the pump means 1 and the flow control means is regulated to control the flow of the combined stream of water and polymer to provide circulation of the combined stream through the first circulation means. More particularly, the first circulation pattern is provided by closing: the valve 19 in the second polymer supply conduit 18, the valve 21 in the second flow conduit 20, and the valve 31 in the recirculation conduit 30; and by opening the valve 13 in the first polymer supply conduit 12 and the valve 23 in the first flow conduit 22. Thus, water is pumped by the pump means 1 from the water source 5 through the water supply conduit 6 to the inlet 2 of the pump means 1. Also, emulsion polymer is pumped by the chemical metering pump means 10 from the vessel 7 through the polymer inlet 9 into the chemical metering pump means 10 and then through the polymer delivery conduit 11 and the first polymer supply conduit 12 to the injection lance means 14 and the inlet 2 of the pump means 1. The water and polymer are combined in the inlet 2 of the pump means 1 to form a combined stream, which is mixed in the pump means 1. The combined stream is then pumped by the pump means 1 through the first flow conduit 22 to the mixing chamber means 24, where the combined stream is further mixed.

Figure 3:
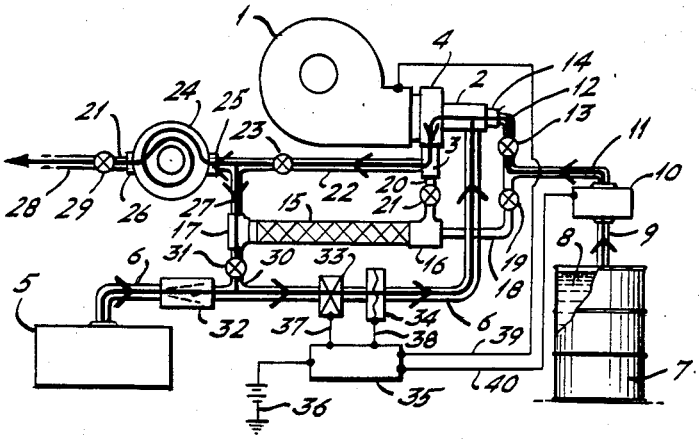
FIG. 3 is a schematic of the embodiment of FIG. 1 showing a second circulation pattern for the flow of the water and polymer through the apparatus.

FIG. 3 illustrates a second circulation pattern or second mixing option which includes circulating the flow through the pump means 1 and then circulating a portion of the combined stream to the mixing chamber means 24 while recirculating another portion of the combined stream through the pump means 1 prior to circulating the combined stream to the mixing chamber means 24. To provide the second circulation pattern, the polymer flow control means is regulated to provide for passage of the emulsion polymer only to the pump means 1 and the flow control means is regulated to control the flow of the combined stream to provide circulation of the combined stream through the first circulation means. Additionally, at least a portion of the combined stream is recirculated through the recirculation means prior to circulating the combined stream to the mixing chamber means 24, as illustrated in FIG. 3. More particularly, the second circulation pattern is provided by closing the valve 19 in the second polymer supply conduit 18 and the valve 21 in the second flow conduit 20; and by opening: the valve 13 in the first polymer supply conduit 12 and the valve 23 in the first flow conduit 22. Furthermore, the valve 31 in the recirculation conduit 30 is modulated to provide optimum rate of recirculation and pressure drop across the pump means 1. Thus, water and emulsion polymer are pumped to the inlet 2 of the pump means 1 and then combined and mixed in the pump means 1 as described above for the first circulation pattern. However, the pump means 1 thereafter pumps a portion of the combined stream through the first flow conduit 22 to the mixing chamber means 24 and pumps another portion of the combined stream through the third flow conduit 27, the recirculation conduit 30 and the water supply conduit 6 to the inlet 2 of the pump means 1, where the recirculated portion of the combined stream is further combined with additional water and emulsion polymer, and mixed in the pump means 1.

Figure 4:
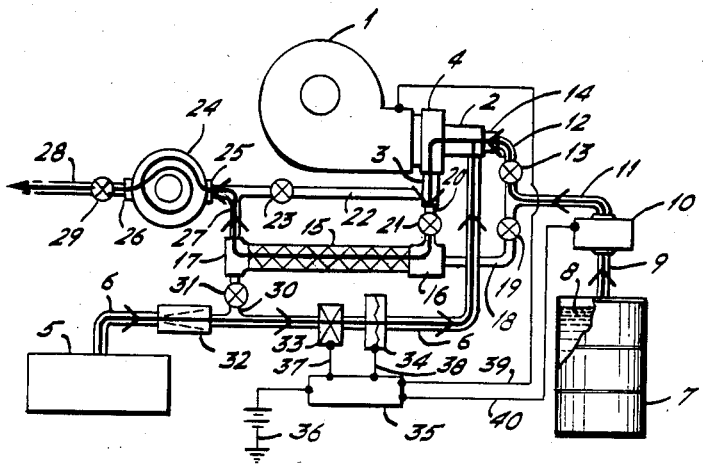
FIG. 4 is a schematic of the embodiment of FIG. 1 showing a third circulation pattern for the flow of the water and polymer through the apparatus.

FIG. 4 illustrates a third circulation pattern or a third mixing option which includes circulating the flow through the pump means 1 and the static mixing means 15 and then to the mixing chamber means 24. To provide the third circulation pattern, the polymer flow control means is regulated to provide for passage of the emulsion polymer only to the pump means 1 and the flow control means is regulated to control the flow of the combined stream to provide circulation of the combined stream through the second circulation means. More particularly, the third circulation pattern is provided by closing: the valve 19 in the second polymer supply conduit 18, the valve 23 in the first flow conduit 22, and the valve 31 in the recirculation conduit 30; and by opening the valve 13 in the first polymer supply conduit 12 and the valve 21 in the second flow conduit 20. Thus, water and emulsion polymer are pumped to the inlet 2 of the pump means 1 and then combined and mixed in the pump means 1 as described above for the first circulation pattern. But the pump means 1 thereafter pumps the combined stream through the second flow conduit 20 to the static mixing means 15, which further mixes the combined stream, and then through the third flow conduit 27 and a portion of the first flow conduit 22 to the mixing chamber means 24 where additional mixing occurs.

Figure 5:
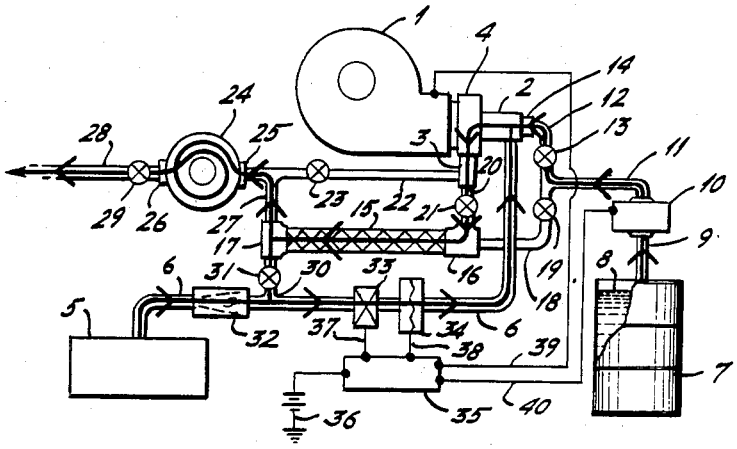
FIG. 5 is a schematic of the embodiment of FIG. 1 showing a fourth circulation pattern for the flow of the water and polymer through the apparatus.

FIG. 5 illustrates a fourth circulation pattern or a fourth mixing option which includes circulating the flow through the pump means 1 and the static mixing means 15 and then circulating a portion of the combined stream to the mixing chamber means 24 while recirculating another portion of the combined stream through the pump means 1 prior to circulating the combined stream to the mixing chamber means 24. To provide the fourth circulation pattern, the polymer flow control means is regulated to provide for passage of the emulsion polymer only to the pump means 1 and the flow control means is regulated to control the flow of the combined stream to provide circulation of the combined stream through the second circulation means. Additionally, at least a portion of the combined stream is recirculated through the recirculation means prior to circulating the combined to the mixing chamber means 24, as illustrated in FIG. 5. More particularly, the fourth circulation pattern is provided by closing the valve 19 in the second polymer supply conduit 18 and the valve 23 in the first flow conduit 22; and by opening: the valve 13 in the first polymer supply conduit 12, the valve 21 in the second flow conduit 20; and by modulating the valve 31 in the recirculation conduit 30 to provide optimum rate of recirculation and pressure drop across the pump means 1. Thus, water and emulsion polymer are pumped to the inlet 2 of the pump means 1 and then combined and mixed in the pump means 1 as described above for the first circulation pattern. However, the pump means 1 thereafter pumps the combined stream through the static mixing means 15 and a portion of the combined stream is then pumped through the third flow conduit 27 and a portion of the first flow conduit 22 to mixing chamber means 24 and another portion of the combined stream is pumped through the recirculation conduit 30 and the water supply conduit 6 to the inlet 2 of the pump means 1, where the recirculated portion of the combined stream is further combined with additional water and emulsion polymer, and mixed in the pump means 1.

Figure 6:
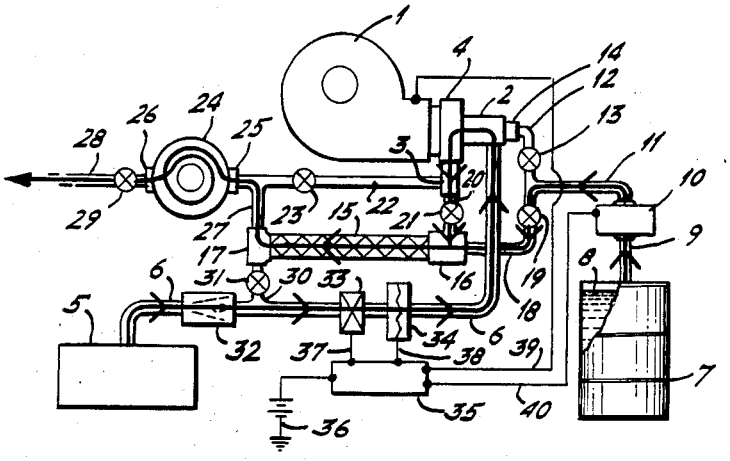
FIG. 6 is a schematic of the embodiment of FIG. 1 showing a fifth circulation pattern for the flow of the water and polymer through the apparatus.

FIG. 6 illustrates a fifth circulation pattern or a fifth mixing option which includes circulating the flow through the static mixing means 15 to the mixing chamber means 24. To provide the fifth circulation pattern, the polymer flow control means is regulated to provide for passage of the emulsion polymer only to the static mixing means 15 and the flow control means is regulated to provide circulation of the water from the pump means 1 to the static mixing means 15 and circulation of the combined stream through the third circulation means, as illustrated in FIG. 6. More particularly, the fifth circulation pattern is provided by closing: the valve 13 in the first polymer supply conduit 12, the valve 23 in the first flow conduit 22 and the valve 31 in the recirculation conduit 30; and by opening the valve 19 in the second polymer supply conduit 18 and the valve 21 in the second flow conduit 20. Thus, water is pumped by the pump means 1 from the water source 5 through the water supply conduit 6 into the pump means 1 and then through the second flow conduit 20 to the inlet 16 of the static mixing means 15. Also, emulsion polymer is pumped by the chemical metering pump means 10 from the vessel 7 through the polymer inlet 9 into the chemical metering pump means 10 and then through the polymer delivery conduit 11 and the second polymer supply conduit 18 to the inlet 16 of the static mixing means 15. The water and polymer are combined in the inlet 16 of the static mixing means 15 to form a combined stream, which is mixed in the static mixing means 15. The pumping action of the pump means 1 and the chemical metering pump means 10 then causes the combined stream to flow through the third flow conduit 27 and a portion of the first flow conduit 22 to the mixing chamber means 24, where the combined stream is further mixed.

The valve 29 in the discharge conduit 28 can be adjusted to regulate the fluid flow rate of the water and polymer mixture and the discharge of the mixture to the point of use in all of the alternate circulation patterns described above.

By adjusting the various valves of the present invention as heretofore described, one of the alternate circulation patterns is selected to sufficiently mix the water and emulsion polymer to displace the surface active dispersants from the water-polymer gel surface to allow the water to contact the polymer and to effectively dissolve the polymer in the water without causing the polymer to shear into smaller polymer molecules. As will be appreciated by those skilled in the art, the instant apparatus provides the specific, optimum amount of mixing energy required for each emulsion polymer supplied to the apparatus. The apparatus is capable of being adjusted to provide the intensity and duration of mixing required to effectively dissolve the emulsion polymer in water and activate the polymer while obtaining a solution having maximum viscosity. Generally, this solution will have a concentration of polymer of about 1% after mixing.

Figure 7:
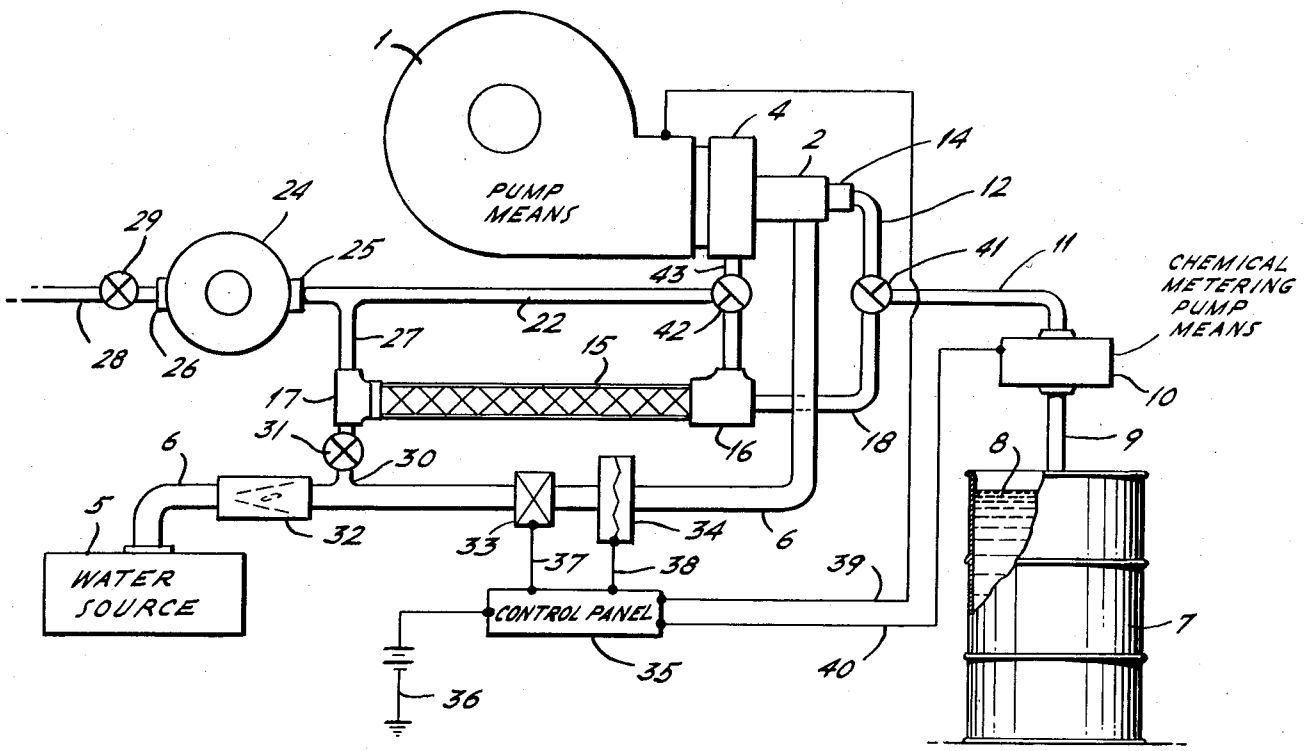
FIG. 7 is a schematic representation showing an alternate embodiment of the apparatus in accordance with the present invention.

FIG. 7 illustrates an alternate embodiment of the present invention in which the polymer flow control means may be comprised of a first three-way directional valve 41 connected to the polymer delivery conduit 11, the first polymer supply conduit 12 and the second polymer supply conduit 18, for controlling fluid flow of the emulsion polymer from the polymer delivery conduit 11 to either the inlet 2 of the pump means 1 or, alternatively, to the inlet 16 of the static mixing means 15. As a further alternate, the flow control means may include a second three-way directional valve 42 connected to the first flow conduit 22, the second flow conduit 20, and a pump outlet conduit 43 connecting the pump means 1 to the second three-way directional valve 42. The second three-way directional valve 42 controls fluid flow of water and emulsion polymer among the pump means 1, the mixing chamber means 24 and the static mixing means 15.

The apparatus of the present invention can be formed of any suitable materials, such as stainless steel, plastics, etc. While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. An apparatus for mixing water and a water-soluble emulsion polymer by providing the optimum amount of mixing energy required for the polymer, which comprises:

(a) a pump means having an inlet adapted to receive and combine the water and the emulsion polymer to form a combined stream of water and emulsion polymer, said pump means being operable to mix the combined stream;

(b) a static mixing means having an inlet adapted to receive and combine the water and the emulsion polymer to form the combined stream, said static mixing means being capable of mixing the combined stream;

(c) a mixing chamber means for producing a homogeneous mixture of the water and emulsion polymer;

(d) a first circulation means connecting the pump means to the mixing chamber means for circulating the combined stream from the pump means to the mixing chamber means;

(e) a second circulation means connecting the pump means to the static mixing means and connecting the static mixing means to the mixing chamber means for circulating the combined stream from the pump means to the static mixing means and then to the mixing chamber means;

(f) a third circulation means connecting the static mixing means to the mixing chamber means for circulating the combined stream from the static mixing means to the mixing chamber means; and (g) a flow control means connected to the first circulation means, the second circulation means and the third circulation means for controlling the flow of the combined stream to selectively circulate the combined stream alternatively through the first circulation means, the second circulation means or the third circulation means, thereby providing sufficient mixing to effectively dissolve the emulsion polymer in the water without causing the polymer molecules to shear into smaller polymer molecules.

2. The apparatus in accordance with claim 1 further comprising a recirculation means connecting the pump means and static mixing means to the inlet of the pump means for recirculating at least a portion of the combined stream through the pump means prior to circulating the combined stream to the mixing chamber means, said recirculation means including a valve connected therein for controlling recirculation of the combined stream.

3. The apparatus in accordance with claim 2 wherein the pump means is a centrifugal pump.

4. The apparatus in accordance with claim 2 wherein the pump means is a turbine pump.

5. An apparatus for mixing water and a water-soluble emulsion polymer having water-polymer gel particles suspended in oil with the aid of surface active dispersants, the mixing being sufficient to displace the surface active dispersants from the water-polymer gel surface to allow the water to contact the polymer and to dissolve the polymer in the water upon initial dilution of the polymer with water, without causing the polymer molecules to shear into smaller polymer molecules, the apparatus comprising:

(a) a first pump means having an inlet and an outlet for pumping water, said first pump means being operable to mix the water and emulsion polymer when the emulsion polymer is supplied to the first pump means;

(b) a chemical metering second pump means for pumping emulsion polymer;

(c) a polymer delivery conduit connected to the chemical metering second pump means;

(d) a first polymer supply conduit connecting the polymer delivery conduit to the inlet of the first pump means;

(e) a static mixing means having an inlet and an outlet for mixing the water and emulsion polymer when water and emulsion polymer are supplied to the static mixing means;

(f) a second polymer supply conduit connecting the polymer delivery conduit to the inlet of the static mixing means;

(g) a polymer flow control means connected to the first polymer supply conduit and the second polymer supply conduit for regulating the passage of the emulsion polymer either to the first pump means or alternatively to the static mixing means;

(h) a mixing chamber means for producing a homogeneous mixture of the water and the emulsion polymer;

(i) a first flow conduit connecting the outlet of the first pump means to the mixing chamber means;

(j) a second flow conduit connecting the outlet of the first pump means to the inlet of the static mixing means;

(k) a third flow conduit connecting the outlet of the static mixing means to the first flow conduit; and (l) a flow control means connected to the first flow conduit and the second flow conduit for regulating the passage of the water and the emulsion polymer from the outlet of the first pumps means to the inlet of the static mixing means and to the mixing chamber means.

6. The apparatus in accordance with claim 5 wherein the polymer flow control means comprises a valve in the first polymer supply conduit for controlling fluid flow of the emulsion polymer from the polymer delivery conduit to the inlet of the first pump means and a valve in the second polymer supply conduit for controlling the fluid flow of the emulsion polymer from the polymer delivery conduit to the inlet of the static mixing means.

7. The apparatus in accordance with claim 5 wherein the flow control means comprises a valve in the second flow conduit for controlling fluid flow between the outlet of the first pump means and the inlet of the static mixing means and a valve in the first flow conduit for controlling fluid flow between the outlet of the first pump means and the mixing chamber means.

8. The apparatus in accordance with claim 5 wherein the first pump means is a centrifugal pump having a rotor face positioned adjacent to the inlet.

9. The apparatus in accordance with claim 5 wherein the first pump means is a turbine pump having a rotor face positioned adjacent to the inlet.

10. The apparatus in accordance with claim 8 or claim 9 further comprising an injection lance means coupled to the inlet of the first pump means and connected to the first polymer supply conduit for injecting the emulsion polymer through the inlet of the first pump means close to the rotor face so as to cause the emulsion polymer to be broken into small droplets.

11. The apparatus in accordance with claim 5 wherein the mixing chamber means is an equalization chamber having transparent chamber walls to serve as a visual indicator that the chemical metering second pump means is pumping the emulsion polymer, said equalization chamber further having a center tube inlet connected to the first flow conduit and a series of distribution orifices connected to an outlet to effect a mixing action of the water and emulsion polymer.

12. The apparatus in accordance with claim 11 further comprising a discharge conduit connecting the outlet of the mixing chamber means to a point of use and a valve in the discharge conduit for throttling the fluid flow rate in the apparatus and controlling the discharge of the mixture of the water and the emulsion polymer.

13. The apparatus in accordance with claim 5 further comprising a source of emulsion polymer and a polymer inlet connecting the source of emulsion polymer to the chemical metering second pump means for supplying the emulsion polymer to the chemical metering second pump means.

14. The apparatus in accordance with claim 5 further comprising a source of water and a water supply conduit connecting the source of water to the first pump means for supplying water to the inlet of the first pump means.

15. The apparatus in accordance with claim 14 further comprising a recirculation conduit connecting the third flow conduit and the outlet of the static mixing means to the water supply conduit for recirculating at least a portion of the mixed water and emulsion polymer to the inlet of the first pump means prior to passage of the mixed water and emulsion polymer to the mixing chamber means, said recirculation conduit including a valve connected therein for controlling fluid flow recirculation of the mixed portion through the recirculation conduit.

16. The apparatus in accordance with claim 14 further comprising a flow measuring means connected to the water supply conduit for monitoring the water flow rate through the water supply conduit.

17. The apparatus in accordance with claim 14 further comprising a flow switch connected to the water supply conduit, said flow switch being operable to detect an inadequate water flow rate in the water supply conduit.

18. The apparatus in accordance with claim 17 further comprising a pressure switch connected to the water supply conduit, said pressure switch being operable to detect inadequate water pressure in the water supply conduit.

19. The apparatus in accordance with claim 18 further comprising a control panel electrically connected to a power source, the flow switch, the pressure switch, the first pump means, and the chemical metering second pump means, for supplying power to energize the first pump means and the chemical metering second pump means, said control means having an automatic switch and an adjustable timer; wherein the flow switch sends an electric signal to the control panel when inadequate water flow is detected and the pressure switch sends an electric signal to the control panel when inadequate water pressure is detected; in the event inadequate water flow is detected or inadequate water pressure is detected, the automatic switch will terminate the supply of power to the chemical metering second pump means and the adjustable timer will terminate the supply of power to the first pump means if adequate water flow and water pressure have not been restored during a preset time interval.

* * * * *